US006846366B2

(12) United States Patent
Kawata et al.

(10) Patent No.: US 6,846,366 B2
(45) Date of Patent: Jan. 25, 2005

(54) CARBURIZING METHOD AND CARBURIZING APPARATUS

(75) Inventors: Kazuki Kawata, Saitama (JP); Hatsuo Sato, Fujimi (JP); Shigeta Asai, Tokyo (JP); Yoshiyuki Sekiya, Kawajima-machi (JP)

(73) Assignee: Oriental Engineering Co., Ltd., Tokyo (JP)

( * ) Notice: Subject to any disclaimer, the term of this patent is extended or adjusted under 35 U.S.C. 154(b) by 171 days.

(21) Appl. No.: 10/044,516

(22) Filed: Jan. 11, 2002

(65) Prior Publication Data

US 2002/0134467 A1 Sep. 26, 2002

(30) Foreign Application Priority Data

Jan. 19, 2001 (JP) ..... 2001-012434

(51) Int. Cl.[7] ..... C21D 1/06
(52) U.S. Cl. ..... 148/216; 266/80; 266/252
(58) Field of Search ..... 266/249, 252, 266/78, 80; 148/216, 215

(56) References Cited

U.S. PATENT DOCUMENTS

| | | | | |
|---|---|---|---|---|
| 2,241,555 A | * | 5/1941 | Krogh et al. | 73/23.31 |
| 4,306,918 A | | 12/1981 | Kaspersma et al. | 148/16.5 |
| 4,445,945 A | * | 5/1984 | Schwalm | 148/16 |
| 4,591,132 A | | 5/1986 | Winning | 266/80 |
| 5,211,820 A | | 5/1993 | Poor et al. | 204/153.18 |
| 5,828,582 A | | 10/1998 | Conklen et al. | 364/529.08 |
| 6,086,251 A | | 7/2000 | Stark | 374/179 |
| 6,187,111 B1 | * | 2/2001 | Waka et al. | 148/223 |

FOREIGN PATENT DOCUMENTS

| | | |
|---|---|---|
| EP | 0 882 811 A1 | 12/1998 |
| JP | 1979-132442 | 10/1979 |
| JP | 59215477 A | 12/1984 |
| JP | 06172960 A | 6/1994 |
| JP | 08325701 A | 12/1996 |
| JP | 0999075 | 5/1998 |
| JP | 11315362 A | 11/1999 |
| JP | 11315363 A | 11/1999 |
| JP | 2000001765 A | 1/2000 |
| JP | 2000-129418 | 5/2000 |
| JP | 20000178710 A | 6/2000 |

OTHER PUBLICATIONS

Office Action of People's Republic of China citing JP 2000–129418 dated Apr. 2, 2004.
Database WPI –XP–002237188, Derwent Publications, Ltd., London, no date.
Copy of International Search Report dated Apr. 4, 2003.

* cited by examiner

*Primary Examiner*—Scott Kastler
(74) *Attorney, Agent, or Firm*—Young & Basile, P.C.

(57) ABSTRACT

There is provided an economical carburizing method and carburization apparatus capable of carrying out carburizing treatment with a quality as high as that in a normal case and a high reproducibility even if carburizing conditions differ from those in a normal case. A carburization apparatus for carrying out carburization in an atmosphere gas containing not more than 30% by volume of carbon monoxide under a pressure of 13 to 4,000 Pa has a carburizing chamber 3 for housing an object 4 to be treated; an oxygen sensor 20 for measuring an oxygen concentration in the atmosphere gas in the carburizing chamber 3 during carburization; and a mass flow controller 5 for adjusting a composition of the atmosphere gas in the carburizing chamber 3 according to a measurement result by the oxygen sensor 20.

4 Claims, 3 Drawing Sheets

SYSTEM BLOCK DIAGRAM

CARBURIZING METHOD AND CARBURIZING APPARATUS

BACKGROUND OF THE INVENTION

1. Field of the Invention

The present invention relates to a carburizing method and a carburizing apparatus mainly for a member made of steel and more particularly to an economical carburizing method and carburizing apparatus both capable of carrying out carburizing treatment with high reproducibility and giving high carburizing quality.

2. Description of the Related Art

As conventional carburizing methods, there exist a gas carburizing method, a plasma carburizing method, a vacuum carburizing method and the like. Among them, the gas carburizing method is a method for carrying out carburization while controlling the atmosphere, so that the carbon concentration in the surface of an object to be treated can stably be controlled. For that, since the carburizng treatment is excellent in the reproducibility and the quality, the method is most widely applied to industrial machinery parts of such as automobiles.

However, the gas carburizing method has problematic disadvantages: that the use amount of a carburizing gas is high; there is danger at the time of burning an exhausted gas; intergranular oxidation takes place in the surface of an object to be treated; carburizing at a high temperature is difficult; and the like.

Although the plasma carburizing method is advantageously capable of carburizing even materials hard to be carburized such as stainless steel, Ti alloys, and the like, it has such problems that an apparatus is costly; carburizing treatment cannot be carried out while objects to be treated being arranged densely; and the quality of objects subjected to the carburizing treatment is unstable, resulting in inferior reproducibility of the carburizing treatment because of the absence of atmosphere control.

The vacuum carburizing method can broadly be divided into two systems. One system, which has been employed for long, is to carry out carbonization using a hydrocarbon such as $CH_4$, $C_3H_8$, $C_4H_{10}$ as a carburizing gas under a pressure as high as about 10 to 70 kPa. The vacuum carburizing method of the old system has such advantages as no intergranular oxidation taking place, capability of carrying out carburizing treatment at a high temperature and possibility to be carried out in a short carburizing time. However, sooting is so intense that a troublesome maintenance work is frequently required and the working environment for the maintenance is inferior. Further, since atmosphere control is not carried out, there is another problem that reproducibility of the carburizing treatment is low.

On the other hand, a vacuum carburizing method of a new system is a system to carry out carburizing treatment using a hydrocarbon such as $C_3H_8$, $C_2H_2$, $C_2H_4$ as a carburizing gas under a pressure as high as about 10 kPa or lower. The vacuum carburizing method of this system has advantages that the sooting is slight as compared with the above described old system; no intergranular oxidation is caused; and high temperature carburization is possible to make the carburizing time short.

SUMMARY OF THE INVENTION

However, even in the case of the vacuum carburizing method of the new system in which the pressure during the carburizing period is 10 kPa or lower, the atmosphere control is not carried out similarly to the above described old system, so that, like the old system, it still has a problem that the reproducibility of the carburizing treatment is low if the carburizing conditions differ from general conditions.

Incidentally, that the carburizing conditions differ from general conditions means, for example, in the case the surface area of objects to be treated or the oxidation degree of the surface of objects to be treated is changed: in the case the construction materials (wall materials) composing a carburizing chamber for carburizing an object to be treated are replaced with new ones: and in the case the leakage amount to the above described carburizing chamber and the amount of a gas evaporated from the above described construction materials are changed.

Further, even though the sooting amount is slight as compared with that in an old system, the degree of the sooting caused at the time of carburizing is not at all monitored, so that the problem is not completely solved.

The invention therefore has a purpose to solve such problems the conventional techniques have and to provide an economical carburizing method and a carburization apparatus excellent in reproducibility of carburizing treatment and capable of carrying out carburization with high quality.

In order to solve the above described problems, the invention is constituted as follows. That is, according to the carburizing method of the invention, a composition of an atmosphere gas is analyzed and at least one of temperature, pressure, and composition of the atmosphere gas is adjusted according to an analysis result during carburization in an atmosphere gas containing not more than 30% by volume of carbon monoxide under a pressure of 13 to 4,000 Pa.

Incidentally, the composition of the above described atmosphere gas during carburization may be analyzed by measuring an oxygen amount in the above described atmosphere gas.

Further, the composition of the above described atmosphere gas during carburization may be analyzed by measuring thermal conductivity of the above described atmosphere gas.

Further, the composition of the above described atmosphere gas during carburization may be analyzed by measuring a hydrogen amount in the above described atmosphere gas.

Further, the carburizing apparatus for carrying out carburization in an atmosphere gas containing not more than 30% by volume of carbon monoxide under a pressure of 13 to 4,000 Pa comprises a carburizing chamber for housing an object to be treated; gas analysis means for analyzing a composition of the atmosphere gas in the foregoing carburizing chamber during a carburizing period; at least one of temperature adjustment means for changing the temperature inside the foregoing carburizing chamber according to an analysis result by the foregoing gas analysis means; pressure adjustment means for changing the pressure inside the foregoing carburizing chamber according to the analysis result by the foregoing gas analysis means; atmosphere gas composition adjustment means for changing the composition of the foregoing atmosphere gas inside the foregoing carburizing chamber according to the analysis result by the foregoing gas analysis means; and an information display apparatus for displaying information of the analysis results according to the analysis results of the foregoing gas analysis means.

Incidentally, the foregoing gas analysis means may be an oxygen sensor. The oxygen sensor is preferable to have an air-tight structure durable to a degree of vacuum of 133 Pa or lower. For that, analysis of the composition of the atmosphere gas during carburization can be carried out without any problem.

Further, the foregoing gas analysis means may be an instrument for measuring thermal conductivity of the foregoing atmosphere gas.

The foregoing gas analysis means may also be a hydrogen sensor.

In such a manner, since carburization is carried out while analyzing the composition of the foregoing atmosphere gas at the time of carburizing and adjusting at least one of temperature, pressure and atmosphere gas composition, that is, since carburization is carried out while monitoring and controlling the foregoing atmosphere gas, the reproducibility of the carburizing treatment is excellent even in the case where a surface area of an object to be treated or an oxidation degree of the surface of an object to be treated is changed: in the case when the construction materials (wall materials) composing a carburizing chamber for carburizing an object to be treated are replaced with new ones: and in the case where a leakage amount to the above described carburizing chamber and an amount of a gas evaporated from the above described construction materials are changed The composition of the atmosphere gas can be adjusted by controlling the type, the amount, the composition and the like of a carburizing gas to be introduced. Further, the adjustment may be carried out by controlling the temperature and the pressure.

Since the analysis results of the foregoing atmosphere gas during carburization are displayed by the foregoing information display apparatus, it is easy to monitor the state (the composition) of the foregoing atmosphere gas and the state of the carburizing treatment. Incidentally, the display of the analysis results may be performed by displaying information with letters or by indication of instruments. Further, display may be performed by using light such as lighting, extinguishing, or flashing a lamp; or using sound and voice such as ringing a buzzer or the like.

Further, based on the analysis results of the atmosphere gas by the foregoing gas analysis means, the composition of the atmosphere gas and the carburizing conditions can be controlled to be optimum, so that the soot generation amount can be suppressed to extremely low.

Further, since the amount of the above described to be consumed can be controlled to the minimum necessary amount, the carburizing method and the carburization apparatus are excellently economical.

And also, the carburizing method and the carburization apparatus scarcely have problems, which the gas carburizing method has, such as danger at the time burning a exhausted gas or the like and deterioration of the environments by emission of a large quantity of $CO_2$. Further, it is possible to carry out high quality carburizing treatment without being accompanied with intergranular oxidation in the surface of an object to be treated.

Hereinafter, the carburizing method and the carburization apparatus of the invention will be described in details.

Regarding Carburizing Treatment Temperature

The treatment temperature in the invention is proper at 730 to 1,100° C. in the case of carburizing treatment and at 650 to 1,100° C. in the case of carbonitriding treatment.

If the treatment temperature of the carburizing treatment is lower than 730° C., sooting easily takes place and if it higher than 1,100° C., the crystal grains easily become coarse.

In the case of the carbonitriding treatment, since the $A_1$ transformation temperature is decreased by penetration of a steel with nitrogen, the proper treatment temperature is 650 to 1,100° C. If the treatment temperature of the carbonitriding treatment is lower than 650° C., sooting easily takes place and if it higher than 1,100° C., the crystal grains easily become coarse.

However, in the case of a special material or a special application, the carburizing treatment and the carbonitriding treatment may be carried out in a temperature out of the above described ranges.

Regarding The Pressure and the Pressure Control Method

The pressure during the carburizing period is proper to be 13 to 4,000 Pa If it is lower than 13 Pa, the carburizing power is so weak to easily result in uneven carburizing treatment. On the other hand, if it is higher than 4,000 Pa, sooting intensely takes place to result in problems that carburization becomes uneven and the maintenance of the inside of the carburization chamber of the carburization apparatus becomes troublesome as well.

If the pressure is kept at 13 to 4,000 Pa during the carburizing period, soot generation can be suppressed and moreover an evenly deep carburizing layer can be formed in the surface of an object to be treated. In order to further improve such an effect, the pressure during the carburizing period is preferable to be 133 to 667 Pa.

Incidentally, the carburizing treatment may be carried out at a constant pressure in a range from 13 to 4,000 Pa, however, depending on the types of objects to be treated, carburizing treatment under the pressure of 13 to 4,000 Pa and carburizing treatment under the pressure of 13 Pa or lower may reciprocally be carried out (in other words, treatment may be carried out under pulsed pressure).

Also, in the case of the carbonitriding treatment, the treatment can be carried out without any problem under the pressure (13 to 4,000 Pa) similarly to the carburizing treatment, however the pressure may slightly be increased more than that of the carburizing treatment.

The pressure decrease of the inside of the carburizing chamber can be carried out by a conventionally used vacuum pump or the like without any problem. A general conductance valve or the like, which is made interlockingly operable with a diaphragm type vacuum gauge operable without being affected with the gas type and the composition, is preferably installed between the carburizing chamber and the foregoing vacuum pump to control the pressure of the inside of the carburizing chamber by the conductance valve or the like.

Regarding the Carbon Monoxide Concentration in the Carburizing Gas and the Atmosphere Gas The examples of the carburizing gas to be used as the atmosphere gas are hydrocarbons such as, which are usable regardless of whether they are gaseous or liquids, such as $CH_4$, $C_3H_8$, $C_4H_{10}$, $C_2H_2$, $C_2H_4$, $C_6H_6$, $C_7H_8$, and the like. They may be used solely or as a mixture of two or more of them. Further, compounds containing C, H, O such as $CH_3OH$, $CH_3COCH_3$, $CH_3COOC_2H_5$, and the like may also be usable as the carburizing gas. Further, $N_2$, $H_2$, $CO_2$, $H_2O$, Ar, He, $O_2$, air and the like may be combined with the above described hydrocarbons and compounds containing C, H, O to be introduced into the inside of the carburizing chamber.

Especially, a carburizing gas containing solely $C_4H_{10}$ or 50% by volume of $C_4H_{10}$ or more has advantageous points that its cost is economical: it is less dangerous as compared with $C_2H_2$: it has strong carburizing power as compared with $CH_4$ and $C_3H_8$: it is accompanied with little sooting: and it provides excellent carburizing quantity with scarce carburizing unevenness.

However, during the carburizing period, it is preferable to keep the carbon monoxide (CO) ratio in the entire atmosphere gas in the inside of the carburizing chamber not more than 30% by volume. If the CO ratio is higher than 30% by volume, the carburizing power becomes weak and the carburizing speed is retarded. Further, intergranular oxidation possibly takes place. In order to sufficiently suppress such bad effects, the CO ratio is further preferable to be kept in 20% by volume or lower.

Regarding the Gas Introduction Method and the Gas Discharge Method to and Out of the Carburizing Chamber An introduction inlet for introducing a carburizing gas into carburizing chamber may be one, however if possible, two or more inlets are preferable to be formed. Further, pneumatic valves are installed in the middle of respective introduction pipeline of gases and the gases are preferable to be introduced with the time lag through the respective introduction inlet by switching the pneumatic valves.

The above described introduction inlets are desirable to have a diameter of 10 mm or narrower of the opening parts and preferable to be so-called nozzle-like one.

An exhaust outlet for discharging the atmosphere gas out of the carburizing chamber may be one, however if possible, two or more outlets are preferable to be formed. Further, pneumatic valves are installed in the middle of respective introduction pipeline of gases and the gases are preferable to be exhausted with the time lag through the respective exhaust outlet by switching the pneumatic valves.

Further, the pneumatic valves of the above described introduction inlets and the pneumatic valves of the above described gas exhaust outlets may interlockingly be operated in a desired manner.

Regarding the Gas Analysis Means for Analyzing the Atmosphere Gas Composition (a) A mass spectrometer such as a quadripole mass spectrometer and a gas chromatographic analyzer and the like have conventionally been known as appliances for analyzing the gas under the decreased pressure as it is and appliances for analyzing the gas after the decreased pressure is restored to be the atmospheric pressure, however since these appliances are costly. Further, generally, these appliances are not so constituted as to analyze the atmosphere gas and control the above described atmosphere gas by feed-back of the results. Consequently, such appliances as described above have not been employed for the carburization apparatus by mass production.

However, these appliances are possible to be employed for the carburization apparatus by mass production in the fixture if the types of gases to be analyzed are restricted to a certain degree to lower the cost and further the appliances are so constituted as to control the atmosphere gas by feed-back of the analysis results.

(b) Oxygen Sensor

The oxygen concentration considerably changes in the atmosphere gas in the inside of the carburizing chamber in the case the surface area of an object to be treated or the oxidation degree of the surface of an object to be treated is changed: in the case the construction materials (wall materials) composing the carburizing chamber for carburizing an object to be treated are replaced with new ones: and in the case the leakage amount to the above described carburizing chamber and the amount of a gas evaporated from the above described construction materials are changed.

That will be described more particularly along with one example. For example, in the case of carrying out carburization while introducing a constant amount of a hydrocarbon, the hydrocarbon supplies carbon to an object to be treated and simultaneously is consumed by reaction with oxygen which the object brings with and oxygen entering into the carburizing chamber owing to leakage or the like, so that if the entire surface area of the object to be treated differs, the oxygen concentration in the atmosphere gas inside the carburizing chamber changes and the carbon concentration in the atmosphere gas also changes. That is, in the case of carrying out carburization while introducing a constant amount of the hydrocarbon, if the entire surface area of the object to be treated is wide, the oxygen concentration in the atmosphere gas inside the carburizing chamber is increased as compared with the that if the entire surface area of the object to be treated is narrow.

As described above, in the case the entire surface area of an object to be treated differs from the normal surface-area, if the oxygen concentration in the atmosphere gas is measured by an oxygen sensor or the like and the introduction amount of a hydrocarbon is controlled (the composition of the atmosphere gas is controlled) based on the measurement result as to keep the proper oxygen concentration, the carbon concentration in the atmosphere gas can be controlled and consequently, the carburizing quality of the object can be kept as usual.

Further, also in the case the construction materials (the wall materials) composing a carburizing chamber to carburize an object to be treated are replaced with new ones or in the case the leakage amount to the foregoing carburizing chamber and the amount of a gas evaporated from the foregoing construction materials are changed, as same as described above, the oxygen concentration in the atmosphere gas changes inside the carburizing chamber during carburization. Consequently, of an object to be treated differs from the normal surface area, if the oxygen concentration in the atmosphere gas is measured by an oxygen sensor or the like and the introduction amount of a hydrocarbon is controlled based on the measurement result as to keep the proper oxygen concentration in the same manner as described above, the carburizing quality of the object can be kept as that in a normal case.

Incidentally, the control of carburizing quality may be controlled by controlling the composition of the atmosphere gas as described above and it can also be controlled by controlling the temperature and the pressure inside the carburizing chamber.

Further, the oxygen sensor can be utilized to detect the occurrence of sooting. That is, because the oxygen concentration in the atmosphere gas in the carburizing chamber differs between the cases of normal carburization without sooting and carburization accompanied with sooting.

Further, if sooting takes place, even if a much amount of a hydrocarbon is introduced, for example, the phenomenon that the electromotive force of the oxygen sensor is lowered occurs. Consequently, if the electromotive force becomes different and the decreasing degree of the electromotive force exceeds a prescribed value, sooting is supposed to take place.

Therefore, the composition and the amount of the atmosphere gas can be changed by decreasing the introduction amount of the hydrocarbon, or the carburizing conditions such as the temperature, the pressure or the like can be changed, or the occurrence of the sooting or giving an alarm to the occurrence_@can be displayed by an information displaying apparatus.

As such an oxygen sensor model, an indirect model and a direct model are usable and a direct type oxygen sensor which can directly be inserted into the carburizing chamber is preferable. Further, an oxygen sensor equipped with an electrodes which does not cause catalytic reaction on decomposition of a hydrocarbon such as methane is preferable. For example, a preferable one is an oxygen sensor made of a solid electrolytic material of mainly zirconium oxide.

Of course, the type and the system of the sensor are not particularly restricted at all if the oxygen sensor is capable of measuring oxygen.

(c) Instrument for Measuring the Thermal Conductivity

The thermal conductivity of the atmosphere gas inside the carburizing chamber during carburization considerably changes in the case the surface area of an object to be treated or the oxidation degree of the surface of an object to be treated is changed: in the case the construction materials (wall materials) composing a carburizing chamber for carburizing an object to be treated are replaced with new ones: and in the case the leakage amount to the above described carburizing chamber and the amount of a gas evaporated from the above described construction materials are changed.

That will be described along with one example. For example, in the case of carrying out carburization while introducing a constant amount of $C_3H_8$ under a constant temperature and a constant pressure, if the entire surface area of an object to be treated is wider than usual, $C_3H_8$ is decomposed more than usual. Consequently, since the amount of $H_2$ generated by decomposition of $C_3H_8$ is increased, the thermal conductivity of the atmosphere gas inside the carburizing chamber is increased (the thermal conductivity of $H_2$ is at least ten times as high as that of $C_3H_8$.).

Consequently, if the thermal conductivity of the atmosphere gas inside the carburizing chamber is measured and the introduction amount of $C_3H_8$ is increased as to keep the thermal conductivity as same as that in the case the entire surface area of an object to be treated is normal, the carbon concentration in the atmosphere gas can be controlled and the carburizing quality of the object can therefore be kept as same as usual.

If $C_3H_8$ is excessively decomposed, it sometimes becomes difficult to carburize an object to be treated sufficiently deeply to the center or if an object to be treated has pores, it sometimes becomes difficult to sufficiently carburize the inner faces of the holes. Hence, in order to reliably keep a sufficient amount of $C_3H_8$, it is preferable to measure the thermal conductivity of the atmosphere gas and control the $C_3H_8$ amount in the atmosphere gas.

Further, also in the case the construction materials (wall materials) composing a carburizing chamber for carburizing an object to be treated are replaced with new ones and in the case the leakage amount to the above described carburizing chamber and the amount of a gas evaporated from the above described construction materials are changed, the thermal conductivity of the atmosphere gas changes during carburization in the same manner as described above. Consequently, as described above, if the thermal conductivity of the atmosphere gas is analyzed by the above described instrument and the introduction amount of $C_3H_8$ is so controlled as to keep a proper thermal conductivity, the carburizing quality of the object can be kept as usual.

Incidentally, the control of the carburizing quality may be carried out by controlling the composition of the atmosphere gas as described above and it can be carried out by controlling the temperature and the pressure inside the carburizing chamber.

Further, if the thermal conductivity of the atmosphere gas is measured and the composition and the amount of the atmosphere gas are kept at proper values, sooting is made difficult to take place.

In the invention, an instrument for directly measuring the thermal conductivity of the atmosphere gas may be employed and those which are not instruments for directly measuring the thermal conductivity but measuring the physical degrees such as the degree of vacuum, the temperature, the resistance, and the like can be employed without any restrictions.

As such instruments, examples are a thermocouple vacuum gauge, a thermister vacuum gauge, a Pirani vacuum gauge, a bimetal vacuum gauge, a convection vacuum gauge, and the like. These instruments are those which measure the physical degrees based on the thermal conductivity and ultimately give an output by converting the physical degrees to the pressure value.

Among them, the Pirani vacuum gauge is most preferable and a constant temperature type Pirani vacuum gauge which can be used in a high pressure is further preferable.

Incidentally, in the invention, the above described vacuum gauges are used for measuring the thermal conductivity of the atmosphere gas inside the carburizing chamber, the pressure of the carburizing chamber is measured by a diaphragm type vacuum gauges and the like which are not affected by the type and the composition of the gas.

Conventionally, the thermocouple vacuum gauge, the thermister vacuum gauge, the Pirani vacuum gauge, the bimetal vacuum gauge, the convection vacuum gauge, and the like are employed for measuring the pressure as an indicator of mainly the achieved degree of vacuum or the like and being different from those in the invention, they are not used for analyzing the composition of the gas and controlling the atmosphere gas for carburization, more particularly, controlling the carbon concentration in the atmosphere gas as in the present invention.

(d) Hydrogen Sensor

The hydrogen concentration considerably changes in the atmosphere gas inside the carburizing chamber in the case the surface area of an object to be treated or the oxidation degree of the surface of an object to be treated is changed: in the case the construction materials (wall materials) composing the carburizing chamber for carburizing an object to be treated are replaced with new ones: and in the case the leakage amount to the above described carburizing chamber and the amount of a gas evaporated from the above described construction materials are changed.

That will be described along with one example. For example, in the case of carrying out carburization while introducing a constant amount of $C_3H_8$ under a constant temperature and a constant pressure, if the entire surface area of an object to be treated is wider than usual, $C_3H_8$ is decomposed more than usual, and consequently the hydrogen concentration increases in the atmosphere gas.

Consequently, if the hydrogen concentration in the atmosphere gas inside the carburizing chamber is measured by a hydrogen sensor or the like and the introduction amount of $C_3H_8$ is increased as to keep the hydrogen concentration as same as that in the case the entire surface area of an object to be treated is normal, the carbon concentration in the atmosphere gas can be controlled and the carburizing quality of the object can therefore be kept as same as usual.

If $C_3H_8$ is excessively decomposed, it sometimes becomes difficult to carburize an object to be treated sufficiently deeply to the center or if an object to be treated has pores, it sometimes becomes difficult to sufficiently carburize the inner faces of the holes. Hence, in order to reliably keep a sufficient amount of $C_3H_8$, it is preferable to measure the hydrogen concentration in the atmosphere gas and control the $C_3H_8$ amount in the atmosphere gas.

Further, also in the case the construction materials (wall materials) composing a carburizing chamber for carburizing an object to be treated are replaced with new ones and in the case the leakage amount to the above described carburizing chamber and the amount of a gas evaporated from the above described construction materials are changed, the hydrogen concentration in the atmosphere gas changes during carburization in the same manner as described above. Consequently, as described above, if the hydrogen concentration in the atmosphere gas is analyzed by the hydrogen sensor or the like and the introduction amount of $C_3H_8$ is so controlled as to keep a proper hydrogen concentration by controlling the introduction amount of $C_3H_8$ based on the measurement results, the carburizing quality of the object can be kept as usual.

Incidentally, the control of carburizing quality may be controlled by controlling the composition of the atmosphere gas as described above and it can also be controlled by controlling the temperature and the pressure inside the carburizing chamber.

Further, if the hydrogen concentration in the atmosphere gas is measured and the composition of the atmosphere gas is kept at a proper value, sooting is made difficult to take place.

As a sensor for measuring the hydrogen concentration, an example to be used is an electrochemical type diaphragm-equipped hydrogen sensor or the like, however the types and the systems are not at all restricted as long as sensors can measure hydrogen.

Since the electrochemical type diaphragm-equipped hydrogen sensor cannot be used in decreased pressure, the atmosphere gas inside the carburizing chamber is either sampled or introduced into another space and after the pressure is increased to the atmospheric pressure by $N_2$, Ar, or the like, the measurement is carried out.

The above described oxygen sensor, instruments for measuring the thermal conductivity, and hydrogen sensor may be used solely or in combination of two or more of them.

Incidentally, since the vacuum carburizing method is not a reaction to be carried out in an equilibrium state of an atmosphere gas just like a gas carburizing method, the carbon concentration in the atmosphere gas cannot be calculated from the values measured by the above described sensors based on the gas equilibrium reaction.

Consequently, the oxygen amount, the hydrogen amount, and the thermal conductivity in the conditions under which no sooting takes place and carburizing treatment is evenly carried out in the atmosphere gas with the minimum necessary limits are required to be previously measured by the above described sensors and the carbon concentration of an object to be treated is previously measured.

At the time of carrying out the carburizing treatment, at least one of the temperature, the pressure, and the atmosphere gas composition may be controlled so as to keep the oxygen amount, the hydrogen amount, and the thermal conductivity of the atmosphere gas be the same values as those of the above described optimum conditions. In order to control the composition of the atmosphere gas, desired kinds of gases or the desired composition of the gases in a desired amount may be introduced into the carburizing chamber to control the composition to be the optimum atmosphere gas.

Consequently, in the case where the conditions for carburizing are changed from normal conditions, in the case the surface area of an object to be treated or the oxidation degree of the surface of an object to be treated is changed: in the case the construction materials (wall materials) composing a carburizing chamber for carburizing an object to be treated are replaced with new ones: and in the case the leakage amount to the above described carburizing chamber and the amount of a gas evaporated from the above described construction materials are changed, if the atmosphere gas is so controlled as to keep the oxygen amount, the hydrogen amount, and the thermal conductivity be the values as same as those of the above described optimum conditions, the carbon concentration in the atmosphere gas can be controlled and the carburizing quality of the object to be treated can be kept as usual.

Regarding the Carbonitriding Treatment

In the case of carrying out the carbonitriding treatment, a carburizing gas mixed with a compound containing nitrogen such as $NH_3$, $C_3H_7NO$ and the like may be used as the atmosphere gas and treatment may be carried out in the same manner. Incidentally, in the case of the carbonitriding treatment, the pressure may be increased more than that in the case of the carburizing treatment

Regarding the Thermal Treatment Pattern

The typical example of the thermal treatment pattern in the case of the carburizing treatment is shown in FIG. 1. As being understood from FIG. 1, the carburizing treatment comprises a temperature increasing step, a first soaking step, a carburizing step, a diffusion step, a temperature decreasing step, and a second soaking step. If the carburizing step and the diffusion step are carried out repeatedly two or more times, it is effective to deepen the carburizing depth.

The temperature increasing step and the first soaking step may be carried out in vacuum at 1.4 Pa or lower pressure or under the pressure of 13 to 67,000 Pa in gas flow. Incidentally, as the gas, $N_2$, $H_2$, $CO_2$, $H_2O$, Ar, He, $O_2$, and air may be used solely or in form of a mixture of two or more of them.

Then, the carburizing step may be carried out in the atmosphere gas and under the pressure described above.

The diffusion step, the temperature decreasing step, and the second soaking step may be carried out in vacuum at 1.4 Pa or lower pressure or under the pressure of 13 to 67,000 Pa in gas flow. As the gas, $N_2$, $H_2$, $CO_2$, $H_2O$, Ar, He, $O_2$, and air may be used solely or in forms of a mixture of two or more of them.

Especially, if the diffusion step is carried out under the pressure of 13 to 4,000 Pa in $H_2$ gas flow, the soot in the object to be treated and inside the carburizing chamber can be removed and it is effective to adjust the carbon concentration in the surface of the object to be treated.

When the object to be treated is transferred from the carburizing chamber to a hardening chamber on completion of the second soaking step, a gas may be passed through the oxygen sensor and the carburizing chamber for the purpose to burn out the gases. As the gas, air, $N_2$, $H_2$, $CO_2$, $H_2O$, $O_2$, and the like may be used solely or in form of a mixture of two or more of them.

Regarding the System Block Diagram

FIG. 4 shows one example of a system block diagram regarding the control of the atmosphere gas and the carburizing conditions in the carburizing treatment.

The carburizing method and the carburizing apparatus of the invention may not be restricted to application to the vacuum carburizing method but can be applied to a variety of systems of the plasma carburizing method.

DETAILED DESCRIPTION OF THE PREFERRED EMBODIMENTS

The embodiments of the carburizing method and the carburization apparatus according to the invention will more particularly be described with the reference to drawings. Incidentally, the embodiments are only examples of the invention and the invention is not at all restricted to these embodiments.

EXAMPLE 1

Figure 1:
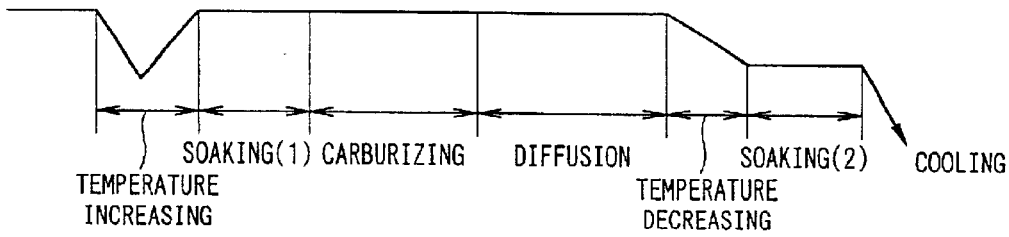
FIG. 1 is an outlined pattern showing a typical thermal treatment pattern in the carburizing treatment.
Figure 2:
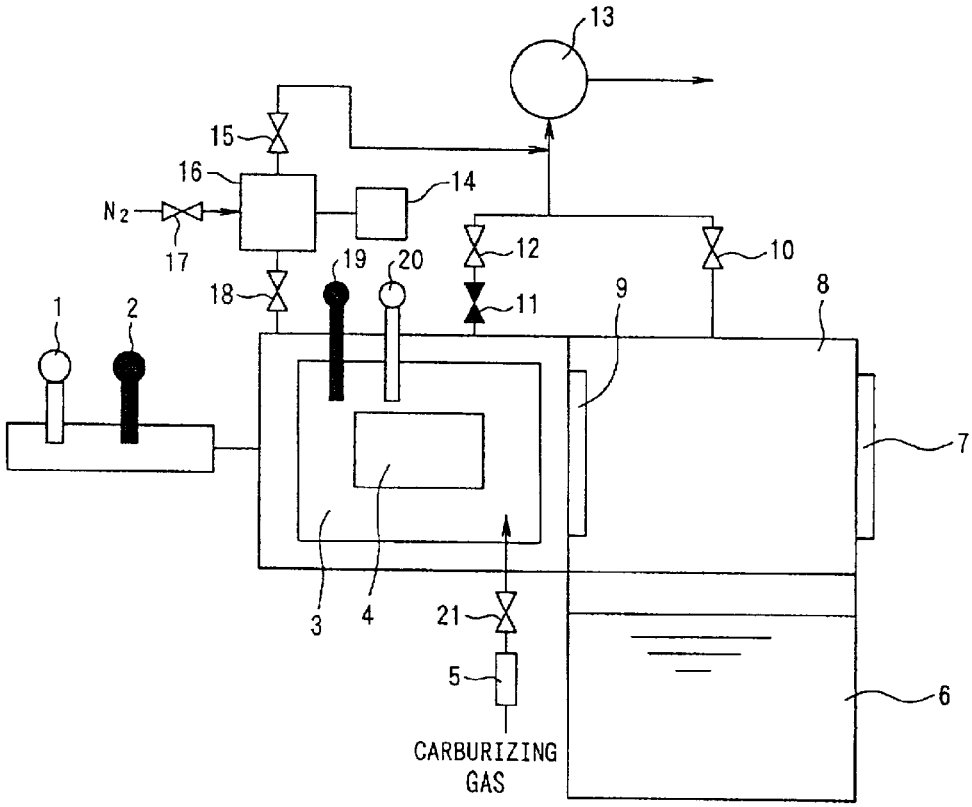
FIG. 2 is a schematic figure showing the structure of a carburization apparatus which is one embodiment of the invention.

FIG. 2 is a schematic figure showing the structure of a carburization apparatus which is one embodiment of the invention. The apparatus is an oil tank-attached batch vacuum carburization apparatus (the effective size of the inside of the carburizing chamber 3: 760 mm length, 380 mm width, and 350 mm height) capable of carburizing an object with the weight of 200 kg.

At first, the structure of the carburization apparatus will be described.

The carburization apparatus is provided with a carburizing chamber 3 for housing each object 4 to be treated and carrying out carburizing treatment, a cooling chamber 8 for air-cooling each object 4 subjected to the carburizing treatment in the carburizing chamber 3, and an oil tank 6 for oil-cooling each object 4 cooled in the cooling chamber 8.

An opening and closing intermediate vacuum door 9 is installed between the carburizing chamber 3 and the cooling chamber 8 to communicate both chambers 3, 8 when the intermediate vacuum door 9 is in opened state. Further, an opening and closing front vacuum door 7 is installed in the cooling chamber 8 to communicate the chamber 8 with atmospheric air when the front vacuum door 7 is in opened state. Further, the oil tank 6 is continuously installed in the lower side of the cooling chamber 8 to carry out oil-cooling of each object 4 to be treated by immersing it in an oil in the oil tank 6.

Further, the carburizing chamber 3 is communicated with a vacuum evacuation apparatus 13 through a pipe to make the carburizing chamber 3 be in vacuum state by the vacuum evacuation apparatus 13. Similarly to the carburizing chamber 3, the cooling chamber 8 is also communicated with the vacuum evacuation apparatus 13 through a pipe to make the cooling chamber 8 be in vacuum state by the vacuum evacuation apparatus 13. Incidentally, vacuum switching valves 10, 12 are installed in the above described respective pipes.

Next, a method for carrying out carburizing treatment of an object made of a steel using such a carburization apparatus as described above will be described below. In this case, even if the entire surface area of an object to be subjected to the carburizing treatment is wider than usual, the carburizing quality of the object to be treated may be kept as high as usual.

In addition to that, even in the case the conditions are different from those in a usual case, such as in the case the construction materials (wall materials) composing a carburizing chamber 3 are replaced with new ones: and in the case the leakage amount to the carburizing chamber 3 and the amount of a gas evaporated from the above described construction materials are changed, the carburizing quality of the object to be treated may similarly be kept as high as usual.

Each object 4 to be treated was a columnar test piece (15 mm diameter, 20 mm length) made of SCM 415 and set in the center section and corner parts (8 points) of the rectangular solid carburizing chamber 3 in total of 9 points using jigs. Further, cylindrical test pieces (48.6 mm outer diameter, 41.6 mm inner diameter, 50 mm length) made of STKM 13A were installed in a proper number with which the entire surface area of them (columnar test piece and cylindrical test piece) became 5 $m^2$ in the carburizing chamber 3 using jigs.

Incidentally, the conditions of carburizing these nine test pieces made of SCM 415 were the conventional carburizing conditions and the test pieces made of STKM 13A were employed for greatly changing the conditions of the carburizing treatment from the conventional conditions by enlarging the entire surface area of the steel material to be subjected to the carburizing treatment.

Figure 3:
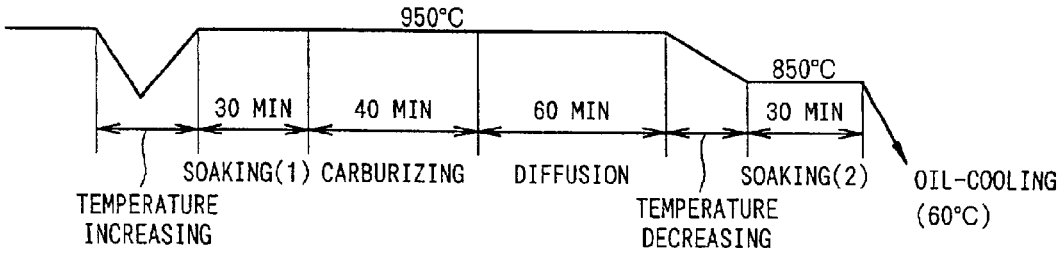
FIG. 3 is an outlined pattern showing the thermal treatment pattern in the carburizing treatment of examples 1 to 3.
Figure 4:
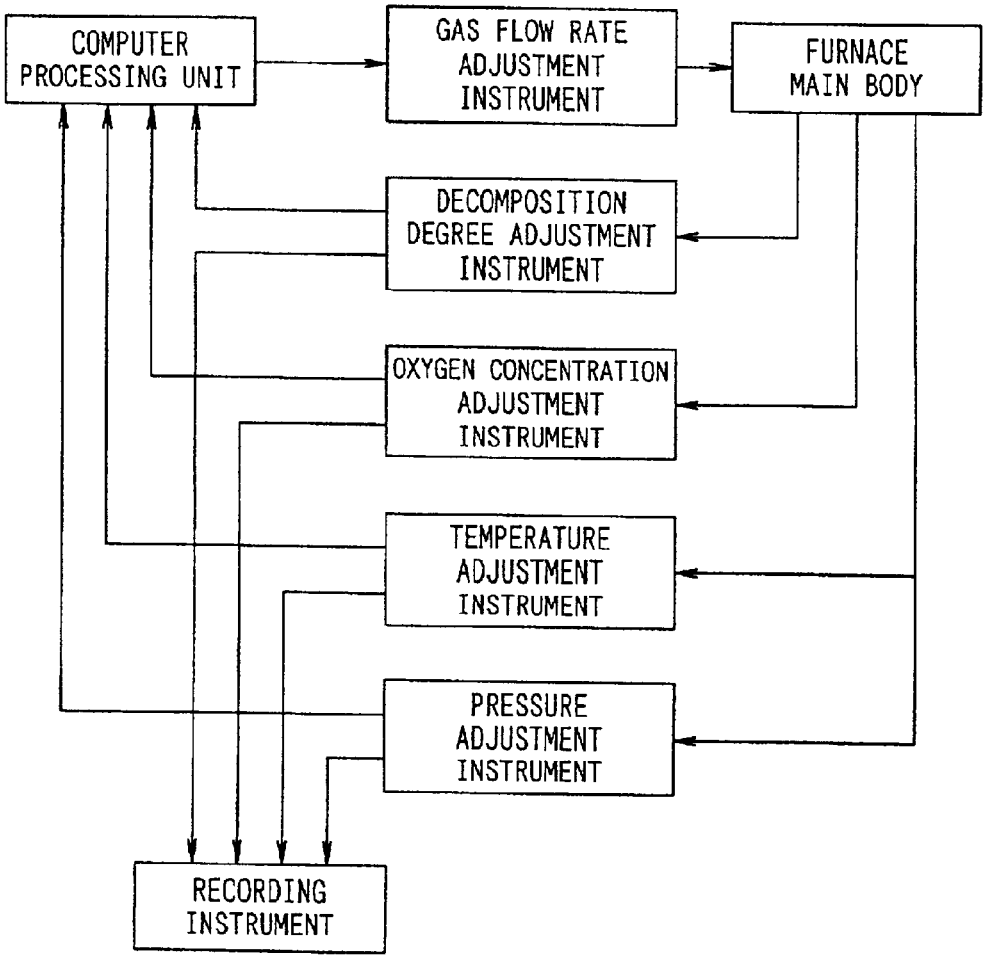
FIG. 4 is an outlined diagram showing one example of a system block diagram relevant to the control of the atmosphere gas and the carburizing conditions in the carburizing treatment.

A carburizing treatment was carried out along with the thermal treatment pattern as shown in FIG. 3. That is, the carburizing chamber 3 was evacuated to be 1.4 Pa or lower pressure by the vacuum evacuation apparatus 13 and after the temperature was increased to 950° C. (the temperature increasing step) by a heating apparatus left out of the figure, it was kept as it was for 30 minutes (the first soaking step). Incidentally, the temperature was measured by a thermocouple 19.

Next, the carburizing chamber 3 was evacuated by the vacuum evacuation apparatus 13 to decrease the pressure and the pressure inside the carburizing chamber 3 was automatically controlled to be at 500 Pa by the conductance value 11 connected to the diaphragm type vacuum gauge 2. After that, carburizing treatment was carried out for 40 minutes (the carburizing step) by introducing a carburizing gas ($C_4H_{10}$) into the inside of the carburizing chamber 3 while controlling the introduction by a mass flow controller 5 and an introduction valve 21 so as to keep the electromotive force detected by an oxygen sensor 20 be 1350 mV, which was a electromotive force in the case of normal carburizing conditions. The average flow rate of the carburizing gas at that time was about 5 L/min. Incidentally, based on necessity, $N_2$, $H_2$, $CO_2$, $H_2O$, Ar, He, $O_2$, air and the like might be introduced solely or in form of a mixture of two or more of them together with the $C_4H_{10}$.

The composition of the atmosphere gas might be controlled based on the oxygen amount in the atmosphere gas measured by the oxygen sensor 20 in such a manner, however it could be controlled based on the thermal conductivity of the above described and the hydrogen amount in the atmosphere gas. In such a case, for example, a constant-temperature type Pirani vacuum gauge 1 or a hydrogen sensor 14 might be employed.

However, since the hydrogen sensor 14 could not be used in vacuum, the atmosphere gas was sampled in a container 16 for hydrogen analysis and the pressure was restored to be the atmospheric pressure with nitrogen and then measurement was carried out by the hydrogen sensor 14.

Further, the carburization apparatus might be equipped with an information display apparatus for showing the analysis results of the atmosphere gas measured by the oxygen sensor 20, the constant-temperature type Pirani vacuum gauge 1 and the hydrogen sensor 14 in form of letter information, with indicators of instruments, lamps, buzzers, or sound and voice. Further, a display apparatus or an alarming apparatus to display the occurrence of sooting might be installed.

Next, while the pressure being kept at 133 Pa, $H_2$ was flushed at a flow rate of 1 L/min for 60 minutes to carry out the diffusion step.

The resulting object 4 was then moved to the cooling chamber 9 and cooled to 850° C. (the temperature decreasing step) and kept for 30 minutes (the second soaking step). The temperature decreasing step and the second soaking step were carried out in vacuum at 1.4 Pa or lower pressure. After that, each object 4 was immersed in an oil to oil-cool to 60° C.

Incidentally, the symbols 15, 17, 18 in FIG. 2 were valves. The conductance valve 11 connected to the diaphragm type vacuum gauge 2 was equivalent to the pressure adjusting means, which is a constituent component of the invention and the mass flow controller 5 was equivalent to the atmosphere gas composition adjusting means.

Regarding each object 4 (each test piece made of SCM 415) obtained in such a manner, the effective case depth (the depth at which the Vicker's hardness was Hv 550), the surface carbon concentration, and sooting state in each object 4 and each jig were evaluated. The results are shown in Table 1 in Example 1.

TABLE 1

| | Dispersion of the effective case depth (mm) | Sooting of objects and jigs | Dispersion of the surface carbon concentration (%) |
|---|---|---|---|
| Example 1 | 0.05 | not at all observed | 0.02 |
| Comparative Example 1 | 0.15 | not at all observed | 0.20 |
| Comparative Example 2 | 0.10 | intense | 0.10 |

The average value of the effective case depth of nine objects 4 was 0.85 mm and the dispersion (the difference of the maximum value and the minimum value) was as narrow as 0.05 mm. The average value of the surface carbon concentration was 0.82% and the dispersion was as narrow as 0.02%. Further, sooting in the objects 4 and the jigs was not at all observed.

In such a manner, even if the carburizing conditions were different from those as usual (in the case the entire surface area of the objects to be treated was wider than that as usual), objects with as high quality as that achieved in usual conditions could stably be obtained.

Contrary, description will be given regarding Comparative Examples of carburizing treatment carried out by a method and an apparatus in the same manner as described in Example 1 except that the atmosphere gas was not at all controlled during the carburizing step.

Comparative Example 1 was carried out by controlling the flow rate of the carburizing gas constantly at 1 L/min and the Comparative Example 2 was carried out by similarly controlling the flow rate of the carburizing gas constantly at 20 L/min.

For Comparative Examples 1, 2, similarly to Example 1, the effective case depth, the surface carbon concentration, and sooting state in each object 4 and each jig were evaluated.

As being understood from the results shown in Table 1, although no sooting was observed in Comparative Example 1, the dispersion of the 61-255,252 A was 0.15 mm and the dispersion of the surface carbon concentration was 0.20% and they were wider than those of Example 1.

On the other hand, in Comparative Example 2 although the dispersion of the effective case depth was 0.10 mm and the dispersion of the surface carbon concentration was 0.10% and they were between the respective values of Example 1 and Comparative Example 1, sooting was intense.

EXAMPLE 2

Carburizing treatment was carried out in the same manner as Example 1 except the point described below.

That is, the pressure of the diffusion step was controlled to be 1.4 Pa or lower and in the carburizing step, carburizing treatment was carried out by introducing a carburizing gas ($C_3H_8$) into the carburizing chamber 3 while controlling the introduction amount by the mass flow controller 5 and the introduction valve 21 so as to keep the pressure measured by a Pirani vacuum gauge 1 to be 2,500 Pa, which is a value of normal carburizing conditions. The average flow rate of the carburizing gas at that time was about 6 L/min.

The evaluation of objects was carried out for Example 2 in the same manner as Example 1. As the results, the dispersion of the effective case depth was as narrow as 0.05 mm and sooting was not at all observed.

EXAMPLE 3

Carburizing treatment was carried out in the same manner as Example 2 except the point described below.

That is, in the carburizing step, carburizing treatment was carried out by introducing a carburizing gas ($C_4H_{10}$) into the carburizing chamber 3 while controlling the introduction amount by the mass flow controller 5 and the introduction valve 21 so as to keep the hydrogen amount measured by the electrochemical diaphragm hydrogen sensor 14 be 0.4% by volume, which is a value of normal carburizing conditions. The average flow rate of the carburizing gas at that time was about 5 L/min.

The evaluation of objects was carried out for Example 3 in the same manner as Example 1. As the results, the dispersion of the effective case depth was as narrow as 0.05 mm and sooting was not at all observed.

As described above, the carburizing method and the carburization apparatus of the invention are capable of carrying out carburizing treatment while monitoring and controlling the atmosphere gas, so that even if the carburizing condiitons differ from normal conditions, carburizing with a quality as high as that in a normal case can be carried out economically with a high reproducibility.

What is claimed is:

1. A carburizing method for carrying out carburization in an atmosphere gas containing less than 20% by volume of carbon monoxide under a pressure of 13 to 1,000 Pa, wherein the carburization is carried out while analyzing the composition of the atmosphere gas by measuring a thermal conductivity with a Pirani vacuum gauge and adjusting at least one of temperature, pressure, and composition of the atmosphere gas according to the analysis result.

2. A carburizing apparatus for carrying out carburization in an atmosphere gas containing less than 20% by volume of carbon monoxide under a pressure of 13 to 1,000 Pa, wherein the carburizing apparatus comprises a carburizing chamber for housing an object to be treated;

gas analysis means at least having a Pirani vacuum gauge for measuring a thermal conductivity for analyzing a composition of the atmosphere gas in said carburizing chamber during carburization;

at least one of temperature adjustment means for changing a temperature inside of said carburizing chamber according to an analysis result by said gas analysis means;

pressure adjustment means for changing a pressure inside of said carburizing chamber according to the analysis result by said gas analysis means;

atmosphere gas composition adjustment means for changing the composition of said atmosphere gas inside of said carburizing chamber according to the analysis result by said gas analysis means;

and an information display apparatus for displaying information of the analysis results according to the analysis results of said gas analysis means.

3. A carburizing apparatus comprising:

a carburizing chamber for housing an object to be treated;

said chamber maintained to a pressure of 13 to 1,000 Pa during carburization and having an atmosphere gas of less than 20% by volume of carbon monoxide;

means for maintaining the atmosphere gas within the chamber at the less than 20% by volume of carbon monoxide;

gas analysis means having a Pirani vacuum gauge for measuring a thermal conductivity for analyzing a composition of the atmosphere gas in the chamber during carburization;

a temperature adjustment means for changing a temperature inside of the chamber according to an analysis result by the gas analysis means;

pressure adjustment means for changing a pressure inside of said carburizing chamber according to the analysis result by said gas analysis means;

atmosphere gas composition adjustment means for changing the composition of said atmosphere gas inside of said carburizing chamber according to the analysis result by said gas analysis means; and an information display apparatus for displaying information of the analysis results according to the analysis results of said gas analysis means.

4. A carburizing method comprising the steps of:

housing an object in a carburizing chamber;

maintaining an atmosphere gas containing less than 20% by volume of carbon monoxide under a pressure of 13 to 1,000 Pa in the carburizing chamber;

measuring a thermal conductivity of the atmosphere gas a Pirani vacuum gauge for analyzing the composition of the atmosphere gas;

using the measured thermal conductivity result for adjusting the composition of the atmosphere gas; and using the measured thermal conductivity result for adjusting at least one of the temperature and pressure of the atmosphere gas.

* * * * *